US008733332B2

(12) United States Patent
Che

(10) Patent No.: US 8,733,332 B2
(45) Date of Patent: May 27, 2014

(54) GENERAL GASOLINE ENGINE

(75) Inventor: Bibo Che, Chongqing (CN)

(73) Assignee: Loncin Motor Co., Ltd., Chongqing (CN)

( * ) Notice: Subject to any disclaimer, the term of this patent is extended or adjusted under 35 U.S.C. 154(b) by 8 days.

(21) Appl. No.: 13/391,973

(22) PCT Filed: Dec. 13, 2011

(86) PCT No.: PCT/CN2011/083901
§ 371 (c)(1),
(2), (4) Date: Feb. 23, 2012

(87) PCT Pub. No.: WO2012/122838
PCT Pub. Date: Sep. 20, 2012

(65) Prior Publication Data

US 2012/0266830 A1 Oct. 25, 2012

(30) Foreign Application Priority Data

Mar. 14, 2011 (CN) ..... 2011 1 0060872

(51) Int. Cl.
*F02B 23/08* (2006.01)
*F02B 23/00* (2006.01)

(52) U.S. Cl.
USPC ..... 123/657; 123/664; 123/665; 123/666

(58) Field of Classification Search
USPC ..... 123/657, 664, 665, 666
See application file for complete search history.

(56) References Cited

U.S. PATENT DOCUMENTS 3,306,271 A * 2/1967 Turlay ..... 123/90.27
(Continued)

FOREIGN PATENT DOCUMENTS

CN 2721880 Y 8/2005
CN 202001097 U 10/2011
(Continued)

*Primary Examiner* — Lindsay Low
*Assistant Examiner* — Charles Brauch
(74) *Attorney, Agent, or Firm* — Harrity & Harrity, LLP

(57) ABSTRACT

The invention discloses a general-purpose gasoline engine, comprising a cylinder block, a cylinder head main body (1), and an intake passage (12) and an exhaust passage (11) arranged on the cylinder head main body (1); an intake valve (5) is arranged on the cylinder head main body (1) correspondingly to the intake passage (12), an exhaust valve (9) is arranged correspondingly to the exhaust passage (11), the intake valve (5) is correspondingly provided with an intake rocker arm (8) and an intake push rod, the exhaust valve (9) is correspondingly provided with an exhaust rocker arm (2) and an exhaust push rod, a combustion chamber surface (13) is formed on the inner side of the cylinder head main body (1), and the combustion chamber surface (13) is of a spherical structure or an arch structure formed of smooth curves; the part of the combustion chamber surface (13) between the intake valve (5) and the exhaust valve (9) forms a nose bridge region (14), and a through air-cooling passage (10) is arranged on the cylinder head main body (1) on the outer side of the nose bridge region (14). The general-purpose gasoline engine in the invention is beneficial to the mixing of combustion gases and has excellent cooling efficiency.

14 Claims, 1 Drawing Sheet

(56) References Cited

U.S. PATENT DOCUMENTS

| | | | | | |
|---|---|---|---|---|---|
| 4,084,556 | A | * | 4/1978 | Villella | 123/316 |
| 4,333,426 | A | * | 6/1982 | Gavasso et al. | 123/90.27 |
| 4,884,539 | A | * | 12/1989 | Ciccarone et al. | 123/310 |
| 5,076,219 | A | * | 12/1991 | Pellerin | 123/59.1 |
| 5,269,270 | A | * | 12/1993 | Suzuki et al. | 123/310 |
| 5,970,933 | A | * | 10/1999 | Ueda et al. | 123/90.39 |
| 6,178,936 | B1 | * | 1/2001 | Kouchi et al. | 123/90.41 |
| 6,220,212 | B1 | * | 4/2001 | Wakeman | 123/90.16 |

FOREIGN PATENT DOCUMENTS

| | | | |
|---|---|---|---|
| CN | 202001127 | U | 10/2011 |
| CN | 102305147 | A | 1/2012 |
| CN | 102305148 | A | 1/2012 |
| JP | 2006250130 | A | 9/2006 |
| JP | 2008190425 | A | 8/2008 |
| WO | 2011/011248 | A2 | 1/2011 |

* cited by examiner

GENERAL GASOLINE ENGINE

TECHNICAL FIELD OF THE INVENTION

The invention relates to power machinery, in particular to a general-purpose gasoline engine.

BACKGROUND OF THE INVENTION

General-purpose gasoline engines are reciprocating piston gasoline engines with broad applications, except applications in vehicle and aerocraft; generally, those with power within 20 kW are called as small general-purpose gasoline engines; and they have high generality and advantages of small volume, small mass, simple and convenient use and operation, and low price. As one of power sources, the general-purpose gasoline engine is used for driving general-purpose machinery, including agriculture and forestry plant protection machinery, garden machinery, power generation sets and construction machinery and the like. As a kind of power machinery using gasoline as fuel, the general-purpose gasoline engine consists of a cylinder, a crank and connecting rod mechanism, a valve system, an fuel supply system, a lubrication system and an ignition system and the like; cylinder head is provided with an intake passage and an exhaust passage and forms a combustion chamber surface together with the cylinder; therefore it is a very important component of the gasoline engine. The mixture of gasoline served as fuel and air combusts in the combustion chamber, a lot of heat is generated and used as driving energy. Parameters of the combustion chamber are essential conditions for guaranteeing the high-efficiency operation of the gasoline engine; simultaneously, the continuous operation of the combustion chamber needs the coordination of the intake system and the exhaust system, if the resistance to intake and exhaust is relatively large, or closure is not tight or accurate, or the action is not smooth, the normal operation of the gasoline engine may be influenced.

Heat generated in the combustion chamber influences the mechanical property of the cylinder head inevitably, particularly for local areas around the intake valve and the exhaust valve, if they cannot be cooled in time, thermal deformation of these areas may be caused to influence the tightness of the intake valve and the exhaust valve, so that normal intake and exhaust are influenced, the working status of the gasoline engine becomes poor, the power is decreased, and the emission is influenced. In the prior art, in order to solve the cooling problem, as a cooling measure for the cylinder head, arrangement of cooling fins on the outer surface is generally adopted, the heat inside the combustion chamber is conducted to the cooling fins through the cylinder head, and taken away through air convention to achieve the purpose of cooling. As the nose bridge region formed on the combustion chamber surface between the intake valve and the exhaust valve is far away from the surface of the cylinder head, most of head cannot be taken away by the cooling fins in time, after the gasoline engine operates for a long time, the foregoing thermal deformation may be caused, so that the power and the emission of the gasoline engine are influenced.

The valve system of the gasoline engine is an essential component to guarantee normal operation of the gasoline engine, the opening and closing of the intake valve and the exhaust valve are respectively controlled by driving elements such as rocker arm assembly; the intake valve and the exhaust valve are respectively provided with rocker arm assemblies used for driving the opening and closing of the valves; the opening and closing of the intake valve and the exhaust valve are matched with suction, combustion and exhaust inside the combustion chamber to maintain normal operation of the gasoline engine. In the prior art, rocker arms and valves are arrayed in rectangular, that is, rocker arms are paratactic and approximately parallel, the intake and exhaust passages are matched with the valves, and a certain space has to be reserved to avoid influencing the quality of the intake and exhaust. It can be seen that the existing arrangement of valves not only occupies a large space, but also mismatches with the intake and exhaust direction of the intake passage and the exhaust passage, so that the power of the gasoline engine is decreased, and the emission is influenced; particularly for a structure with obliquely arranged valves, the occupation space may be further increased, and the arrangement of other components (such as carburetor/air filter and other parts) may be influenced.

Therefore, it is necessary to improve the existing general-purpose gasoline engine to make it have a combustion chamber structure with smaller surface to volume ratio, so that the cooling effect is good, the intake and exhaust resistance is reduced, the intake and exhaust valves have excellent tightness effect, the arrangement of other components is benefited, the operation efficiency of the gasoline engine is improved, the fuel is saved, and the emission is reduced.

SUMMARY OF THE INVENTION

Therefore, the invention provides a general-purpose gasoline engine having a combustion chamber structure with smaller surface to volume ratio, the cooling efficiency is good. The intake and exhaust resistance is reduced, and the intake and exhaust valves have excellent tightness effect. The arrangement of other components is benefited, the operation efficiency of the gasoline engine is improved, the fuel is saved, and the emission is reduced.

The general-purpose gasoline engine comprises a cylinder block, a cylinder head main body, and an intake passage and an exhaust passage arranged on the cylinder head main body; an intake valve is arranged on the cylinder head main body correspondingly to the intake passage, an exhaust valve is arranged correspondingly to the exhaust passage, the intake valve is correspondingly provided with an intake rocker arm and an intake push rod, the exhaust valve is correspondingly provided with an exhaust rocker arm and an exhaust push rod, a combustion chamber surface is formed on the inner side of the cylinder head main body, and the combustion chamber surface is of a spherical structure or an arch surface formed of smooth curves; and the part of the combustion chamber surface between the intake valve and the exhaust valve forms a nose bridge region, and a through air-cooling passage is arranged on the cylinder head main body on the outer side of the nose bridge region.

Further, the connecting line of the axis of the intake valve and the axis of the exhaust valve and the connecting line of the axis of the intake push rod and the axis of the exhaust push rod are intersected between the axis of the intake push rod and the axis of the exhaust push rod.

Further, the top of the intake valve is oblique towards the intake passage, and the top of the exhaust valve is oblique towards the exhaust passage; and the air-cooling passage is located between the intake valve and the exhaust valve.

Further, the combustion chamber surface is of an arch structure formed by smooth transition of at least three smooth curves from the bottom to the top in turn, and the smooth curves are paraboloids or hyperboloids. Through the combustion chamber, the defects that the existing integrally global structure is not beneficial to the sufficient mixing of combustion gases, the mixing efficiency is decreased and combustion and emission are influenced can be eliminated better, as curve transition is beneficial to the mixing of combustion gases, the introduced air current may suffer from resistances from different directions, as a result, the fuel mixture can form turbulence better, the combustion is more sufficient, the fuel consumption ratio is decreased effectively, the combustion is benefited, the emission is reduced, and the power of the gasoline engine is increased.

Further, a ribbed cooling bridge is integrated with the cylinder head main body in the air-cooling passage, and the ribbed cooling bridge is arranged in the air-cooling passage along the longitudinal direction and vertical to the mounting plane of the cylinder head main body. The cooling bridge structure is good to guarantee the strength of the cylinder head after turning up the air-cooling passages with large cross section, and to increase the deformation resistance capability of the cylinder head particularly under large width; simultaneously, through the cooling bridge, the heat radiation and conduction area during cooling is increased, which is further conducive to cooling.

Further, the axis of the intake valve and the axis of the exhaust valve are respectively vertical to the tangent plane of the combustion chamber surface at the intersection points of the combustion chamber surface and the respective axis. The intake valve and the exhaust valve are adapted to the intake and exhaust direction of the combustion chamber, so that the resistance is reduced, and the dynamic property of the gasoline engine is increased.

Further, the internal end of the seat retainer of the intake valve and the internal end of the seat retainer of the exhaust valve are matched with the shape of the combustion chamber surface. The end surface shapes of the internal end of the seat retainer of the intake valve and the internal end of the seat retainer of the exhaust valve are matched with the shape of the combustion chamber surface, stairs are removed, interference to intake and exhaust is decreased, the resistance is reduced, the dead angle and the sharp shape change are eliminated, the sufficient combustion of the mixed gases is guaranteed, and the efficiency of the gasoline engine is improved.

Further, the connecting line of the axis of the intake valve and the axis of the exhaust valve and the connecting line of the axis of the intake push rod and the axis of the exhaust push rod are intersected between the axis of the intake push rod and the axis of the exhaust push rod, and the included angle between the two connecting lines is 90 degrees minus or plus 20 degrees. With the structure, the arrangement regions of the valves form a triangle, a small arrangement area is occupied, the arrangement of other components is convenient without changing the existing arrangement of the push rods, particularly for a gasoline engine with a vertical axis, a obliquely arranged valve structure of a built-down camshaft can be achieved, the included angles between the intake and exhaust valves and the intake and exhaust passages are smaller than those in the combustion chamber surface of the existing structure, so that intake tumbling and intake swirl inside the cylinder are organized conveniently, the intake efficiency is improved, current perturbation inside the cylinder is increased, the combustion is boosted, and the power of the gasoline engine is increased; the resistance for intake and exhaust is reduced, so that intake and exhaust are smoother, the power of the gasoline engine is increased, the fuel consumption is reduced, and the tail gas emission is reduced; as a large included angle, preferably 90 degrees, is provided, the standardization of manufacturing is easy to achieve; the region of the valves is made as a equilaterally triangular structure as much as possible to reduce the occupation area; the connecting line of the axis of the intake valve and the axis of the exhaust valve is located between the intake push rod and the exhaust push rod, so that the intake passage can be arranged conveniently, the resistance to intake and exhaust is minimized, and the performance of the gasoline engine is improved; and, parts such as carburetor/air filter can be arranged conveniently, and the reconstruction cost can be reduced.

Further, the gasoline engine is of a vertical shaft structure, the connecting line of the axis of the intake valve and the axis of the exhaust valve is horizontal, both the intake direction of the intake passage and the exhaust direction of the exhaust passage are on a horizontal plane, the top of the intake valve is oblique towards the intake passage along the horizontal direction, and the top of the exhaust valve is oblique towards the exhaust passage along the horizontal direction. The arrangement of intake and exhaust in the horizontal direction avoids staggering of intake and exhaust, makes intake and exhaust smoother, makes the arrangement of the air passages of the cylinder head more regular, boosts the air current to enter into the cylinder to form tumbling, boosts combustion and improves the working efficiency of the gasoline engine.

Further, the intake passage is located between the intake push rod and the exhaust push rod, and the length of the intake rocker arm is smaller than the length of the exhaust rocker arm; and the resisting arm of the exhaust rocker arm is oblique towards the connecting line of the axis of the intake valve and the axis of the exhaust valve in a vertical plane. In this structure, the oblique arrangement of valves is adopted, it is not needed to change the original arrangement structure of the push rods, and the resisting arm of the exhaust rocker arm is oblique inwards to be able to match with the arrangement of the intake and exhaust valves; and, the resisting arm is oblique, so that no additional moment is generated when the exhaust rocker arm is driven by the exhaust push rod, the flexibility thereof is guaranteed.

Further, the included angle between the axis of the intake valve and the axis of the exhaust valve is smaller than or equal to 30 degrees. An enough oblique angle is guaranteed, and the smoothness of intake and exhaust is guaranteed; simultaneously, an enough width between the nose bridge region and the intake/exhaust valves is guaranteed to have better cooling effect.

Further, the intake rocker arm is arranged in an intake rocker arm base through an intake rocker arm shaft, and the exhaust rocker arm is arranged in an intake rocker arm base through an exhaust rocker arm shaft; the included angle between the axis of the intake rocker arm shaft and the axis of the exhaust rocker arm shaft is 45 degrees minus or plus 20 degrees in the vertical plane. This arrangement meets the requirement of the arrangement of the rocker arms, additional moment is avoided when the rocker arms are driven by the push rods, and the harmony, tightness and flexibility of the action of driving valves by the rocker arms are guaranteed; and, the rocker arms can be arranged rationally according to the position of the intake and exhaust valves, to better guarantee the valve timing and the gas distribution phase, so as to improve the performance and reduce the emission.

The invention has the following beneficial effects: in the general-purpose gasoline engine provided in the invention, a combustion chamber with a small surface to volume ratio is adopted, and a nose bridge region cooling passage is arranged between the intake valve and the exhaust valve, therefore the combustion chamber structure with smaller surface to volume ratio has good cooling effect. A structure, in which the valves are obliquely arranged and the connecting line of the axis of the intake valve and the axis of the exhaust valve and the connecting line of the axis of the intake push rod and the axis of the exhaust push rod are intersected, is adopted, so that the working efficiency of the gasoline engine is improved, and the defects that the existing integrally global structure is not beneficial to the sufficient mixing of combustion gases, the mixing efficiency is decreased and combustion and emission are influenced are eliminated. Besides, as curve transition is beneficial to the mixing of combustion gases, a squish region is added, the introduced air current may suffer from resistances from different directions, as a result, the fuel mixture can form turbulence better, the combustion is more sufficient, the fuel consumption ratio is decreased effectively, the combustion is benefited, the emission is reduced, and the power of the gasoline engine is increased. The oblique arrangement of valves is adapted to the structure of the combustion chamber, so that intake tumbling and intake swirl inside the cylinder are organized conveniently, the intake efficiency is improved, current perturbation inside the cylinder is increased, the combustion is boosted, and the power of the gasoline engine is increased. The resistance for intake and exhaust is reduced, so that intake and exhaust are smoother, the power of the gasoline engine is increased, the fuel consumption is reduced, and the tail gas emission is reduced. Simultaneously, the oblique arrangement of valves can make the nose bridge region between the intake passage and the exhaust passage wider, the cooling is benefited, the deformation resistance performance is increased, the cooling effect of the nose bridge region is improved greatly, the deformation of the cylinder head under high temperature is decreased, and the reliability is improved. Completely through air-cooling passages and the oblique arrangement of valves increase the cross sections of the cooling passages, greatly improve the cooling effect of the nose bridge region, decrease the deformation of the cylinder head under high temperature, and improve the reliability of the tightness of the valves. Besides, the air-cooling passages are through from top to bottom, which is matched with the top-to-bottom direction of the cooling air of the shaft-axis gasoline engine, so that no additional air guide device is needed, and excellent cooling effect is obtained. A structure, in which the connecting line of the axis of the intake valve and the axis of the exhaust valve and the connecting line of the axis of the intake push rod and the axis of the exhaust push rod are intersected, is adopted to form a triangular region, so that a small arrangement area is occupied, the arrangement of other components is convenient without changing the existing arrangement of the push rods; the intake and exhaust passages can be arranged according to the demands of intake and exhaust, so that the quality of intake and exhaust of the cylinder is guaranteed, the resistance to exhaust is reduced, the power of the engine is increased, and the emission is reduced. The emitted HC and NOx in the invention reach even exceed the America EPA standard, take a gasoline engine with a maximum power of 3.0 kW (revolving speed: 3600 rpm) for example, the power can be increased to 3.8 kW, and the emission can be reduced from 9.0 g/kW.h to 7.8 g/kW.h; take a gasoline engine with a maximum power of 3.5 kW for example, the power can be increased to 4.3 kW, and the emission can be reduced from 9.0 g/kW.h to 7.9 g/kW.h, both the emissions can meet the standard of 10 g/kW.h in EPA3 stage.

Thus it can be seen that the increase of the power and the reduction of the emission of the gasoline engine in the invention are relatively obvious, which is beneficial to the protection of environment.

BRIEF DESCRIPTION OF THE DRAWINGS

The invention will be further described below with reference to drawings and embodiments.

DETAILED DESCRIPTION OF THE INVENTION

Figure 1:
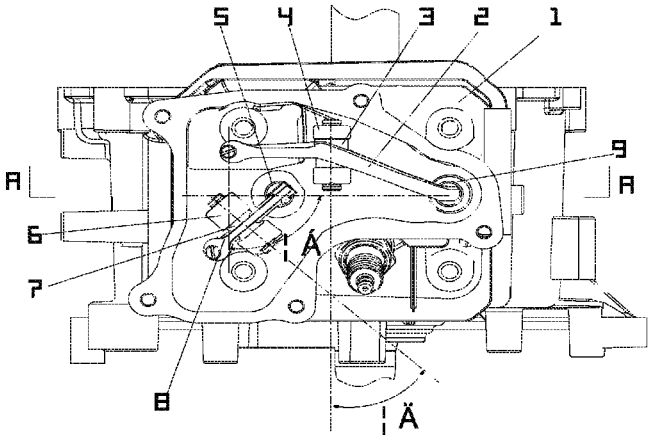
FIG. 1 shows a structure view of the invention.
Figure 2:
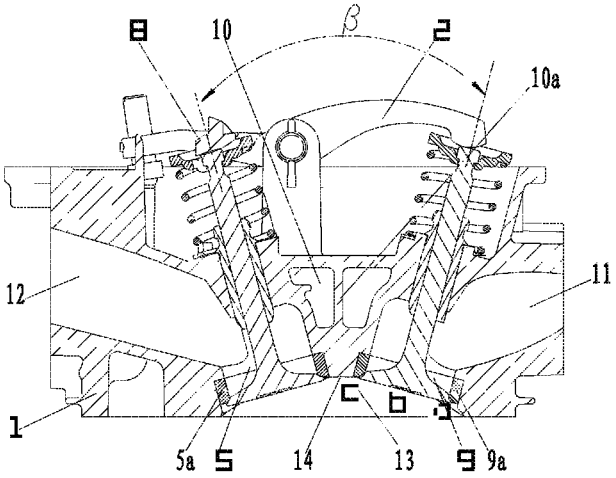
FIG. 2 shows a sectional view of FIG. 1 along the direction A-A.

FIG. 1 shows a structure view of the invention, and FIG. 2 shows a sectional view of FIG. 1 along the direction A-A. As shown in drawings: the general-purpose gasoline engine in the embodiment comprises a cylinder block (not shown in the drawings), a cylinder head main body 1, and an intake passage 12 and an exhaust passage 11 arranged on the cylinder head main body 1; an intake valve 5 is arranged on the cylinder head main body 1 correspondingly to the intake passage 12, an exhaust valve 9 is arranged correspondingly to the exhaust passage 11, the intake valve 5 is correspondingly provided with an intake rocker arm 8 and an intake push rod (not shown in the drawings), the exhaust valve 9 is correspondingly provided with an exhaust rocker arm 2 and an exhaust push rod(not shown in the drawings), a combustion chamber surface 13 is formed on the inner side of the cylinder head main body 1, and the combustion chamber surface 13 is of a spherical structure or an arch surface formed of smooth curves.

The part of the combustion chamber surface 13 between the intake valve 5 and the exhaust valve 9 forms a nose bridge region 14, and a through air-cooling passage 10 is arranged on the cylinder head main body 1 on the outer side of the nose bridge region 14.

The connecting line of the axis of the intake valve 5 and the axis of the exhaust valve 9 and the connecting line of the axis of the intake push rod and the axis of the exhaust push rod are intersected between the axis of the intake push rod and the axis of the exhaust push rod. As both the intake push rod and the exhaust push rod are vertically rejected on the intake rocker arm 8 and the exhaust rocker arm 2, the contact points of the intake rocker arm 8 and the exhaust rocker arm 2 with the intake push rod and the exhaust push rod can reflect the position of the axes of the intake push rod and the exhaust push rod. As shown in FIG. 1, the included angle, between the connecting line of the contact points of the intake rocker arm 8 and the exhaust rocker arm 2 with the intake push rod and the exhaust push rod and the connecting line of the axis of the intake valve 5 and the axis of the exhaust valve 9, is the included angle, between the connecting line of the axis of the intake valve 5 and the axis of the exhaust valve 9 and the connecting line of the axis of the intake push rod and the axis of the exhaust push rod.

The top of the intake valve 5 is oblique towards the intake passage 12, and the top of the exhaust valve 9 is oblique towards the exhaust passage 11; and the air-cooling passage 10 is located between the intake valve 5 and the exhaust valve 9.

In the embodiment, the combustion chamber surface 13 is of an arch structure formed by smooth transition of at least three smooth curves from the bottom to the top in turn, and the smooth curves are paraboloids or hyperboloids. In the embodiment, three smooth curves (respectively, paraboloid a, hyperboloid b and paraboloid c) are adopted, the smooth curves may be other combinations of paraboloids and hyperboloids to form a combustion chamber with an arch structure together. Through the combustion chamber, the defects that the existing integrally global structure is not beneficial to the sufficient mixing of combustion gases, the mixing efficiency is decreased and combustion and emission are influenced can be eliminated better, as curve transition is beneficial to the mixing of combustion gases, the introduced air current may suffer from resistances from different directions, as a result, the fuel mixture can form turbulence better, the combustion is more sufficient, the fuel consumption ratio is decreased effectively, the combustion is benefited, the emission is reduced, and the power of the gasoline engine is increased.

In the embodiment, a ribbed cooling bridge 10*a* is integrated with the cylinder head main body 1 in the air-cooling passage 10, and the ribbed cooling bridge 10*a* is arranged in the air-cooling passage 10 along the longitudinal direction and vertical to the mounting plane of the cylinder head main body 1. The cooling bridge structure is good to guarantee the strength of the cylinder head after turning up the air-cooling passages with large cross section, and to increase the deformation resistance capability of the cylinder head particularly under large width; simultaneously, through the cooling bridge, the heat radiation and conduction area during cooling is increased, which is further conducive to cooling.

In the embodiment, the axis of the intake valve 5 and the axis of the exhaust valve 9 are respectively vertical to the tangent plane of the combustion chamber surface 13 at the respective intersection points of the combustion chamber surface and the respective axis, and the intake valve 5 and the exhaust valve 9 are adapted to the intake and exhaust direction of the combustion chamber, so that the resistance is reduced, and the dynamic property of the gasoline engine is increased.

In the embodiment, the internal end of the seat retainer 5*a* of the intake valve 5 and the internal end of the seat retainer 9*a* of the exhaust valve 9 are matched with the shape of the combustion chamber surface 13. The called matching means matching in shape. The end surface shapes of the internal end of the seat retainer 5*a* of the intake valve 5 and the internal end of the seat retainer 9*a* of the exhaust valve 9 are matched with the shape of the combustion chamber surface 13, stairs are removed, interference to intake and exhaust is decreased, the resistance is reduced, the dead angle and the sharp shape change are eliminated, the sufficient combustion of the mixed gases is guaranteed, and the efficiency of the gasoline engine is improved.

In the embodiment, as shown in FIG. 1, the connecting line of the axis of the intake valve 5 and the axis of the exhaust valve 9 and the connecting line of the axis of the intake push rod and the axis of the exhaust push rod are intersected between the axis of the intake push rod and the axis of the exhaust push rod, and the included angle $\alpha$ between the two connecting lines is 90 degrees minus or plus 20 degrees. With the structure, the arrangement regions of the valves form a triangle, a small arrangement area is occupied, the arrangement of other components is convenient without changing the existing arrangement of the push rods, particularly for a gasoline engine with a vertical axis, a obliquely arranged valve structure of a built-down camshaft can be achieved, the included angles between the intake and exhaust valves and the intake and exhaust passages are smaller than those in the combustion chamber surface of the existing structure, so that intake tumbling and intake swirl inside the cylinder are organized conveniently, the intake efficiency is improved, current perturbation inside the cylinder is increased, the combustion is boosted, and the power of the gasoline engine is increased; the resistance for intake and exhaust is reduced, so that intake and exhaust are smoother, the power of the gasoline engine is increased, the fuel consumption is reduced, and the tail gas emission is reduced; as a large included angle, preferably 90 degrees, is provided, the standardization of manufacturing is easy to achieve; the region of the valves is made as a equilaterally triangular structure as much as possible to reduce the occupation area; the connecting line of the axis of the intake valve and the axis of the exhaust valve is located between the intake push rod and the exhaust push rod, so that the intake passage can be arranged conveniently, the resistance to intake and exhaust is minimized, and the performance of the gasoline engine is improved; and, parts such as carburetor/air filter can be arranged conveniently, and the reconstruction cost can be reduced.

In the embodiment, the gasoline engine is of a vertical shaft structure, the connecting line of the axis of the intake valve 5 and the axis of the exhaust valve 9 is horizontal, both the intake direction of the intake passage 12 and the exhaust direction of the exhaust passage 11 are on a horizontal plane, the top of the intake valve 5 is oblique towards the intake passage 12 along the horizontal direction, and the top of the exhaust valve 9 is oblique towards the exhaust passage 11 along the horizontal direction. The arrangement of intake and exhaust in the horizontal direction avoids staggering of intake and exhaust, makes intake and exhaust smoother, makes the arrangement of the air passages of the cylinder head more regular, boosts the air current to enter into the cylinder to form tumbling, boosts combustion and improves the working efficiency of the gasoline engine.

In the embodiment, the intake passage 12 is located between the intake push rod and the exhaust push rod, and the length of the intake rocker arm 8 is smaller than the length of the exhaust rocker arm 2; and the resisting arm of the exhaust rocker arm 2 is oblique towards the connecting line of the axis of the intake valve 5 and the axis of the exhaust valve 9 in a vertical plane. As the rocker arms (for the intake valve or the exhaust valve) are of a lever structure, the rocker arm shafts are used as the fulcrums, the part used for driving the valves is a resisting arm, the part coordinated with the push rods is a power arm. In this structure, the oblique arrangement of valves is adopted, it is not needed to change the original arrangement structure of the push rods, and the resisting arm of the exhaust rocker arm is oblique inwards to be able to match with the arrangement of the intake and exhaust valves; and, the resisting arm is oblique, so that no additional moment is generated when the exhaust rocker arm is driven by the exhaust push rod, the flexibility thereof is guaranteed.

In the embodiment, as shown in FIG. 2, the included angle $\beta$ between the axis of the intake valve 5 and the axis of the exhaust valve 9 is smaller than or equal to 30 degrees. In the embodiment, the included angle is 30 degrees. An enough oblique angle is guaranteed, and the smoothness of intake and exhaust is guaranteed; simultaneously, an enough width between the intake valve and exhaust valve and an enough width of the nose bridge region is guaranteed to have better cooling effect.

In the embodiment, the intake rocker arm 8 is arranged in an intake rocker arm base 6 through an intake rocker arm shaft 7, and the exhaust rocker arm 2 is arranged in an exhaust rocker arm base 4 through an exhaust rocker arm shaft 3; the included angle $\delta$ between the axis of the intake rocker arm shaft 7 and the axis of the exhaust rocker arm shaft 3 is 45degrees minus or plus 20 degrees in the vertical plane. In the embodiment, the included angle is 45 degrees. This arrangement meets the requirement of the arrangement of the rocker arms, additional moment is avoided when the rocker arms are driven by the push rods, and the harmony, tightness and flexibility of the action of driving valves by the rocker arms are guaranteed; and, the rocker arms can be arranged rationally according to the position of the intake and exhaust valves, to better guarantee the valve timing and the gas distribution phase, so as to improve the performance and reduce the emission.

Finally, it should be noted that above embodiment is just used for explaining but not limiting the technical solution of the invention; although the invention has been described in details with reference to the preferred embodiment, it should be understood by common technicians in the field that the technical solution of the invention may have modifications or equivalent replacements within the principle and scope of the technical solution of the invention, and those modifications or equivalent replacements should be included in the protection scope of the invention.

The invention claimed is:

1. A general-purpose gasoline engine, comprising a cylinder block, a cylinder head main body (1), and an intake passage (12) and an exhaust passage (11) arranged on the cylinder head main body (1); an intake valve (5) is arranged on the cylinder head main body (1) correspondingly to the intake passage (12), an exhaust valve (9) is arranged correspondingly to the exhaust passage (11), the intake valve (5) is correspondingly provided with an intake rocker arm (8) and an intake push rod, the exhaust valve (9) is correspondingly provided with an exhaust rocker arm (2) and an exhaust push rod, and a combustion chamber surface (13) is formed on the inner side of the cylinder head main body (1); wherein:

the combustion chamber surface (13) is of a spherical structure or an arch surface formed of smooth curves;

a part of the combustion chamber surface (13) between the intake valve (5) and the exhaust valve (9) forms a nose bridge region (14), and a through air-cooling passage (10) is arranged on the cylinder head main body (1) on an outer side of the nose bridge region (14); and a ribbed cooling bridge (10*a*) is integrated with the cylinder head main body (1) in the through air-cooling passage (10), the ribbed cooling bridge (10*a*) is arranged in the through air-cooling passage (10) along a longitudinal direction and vertical to a mounting plane of the cylinder head main body (1), and the ribbed cooling bridge (10*a*) connects a top surface of the air-cooling passage (10) with a bottom surface of the air-cooling passage (10).

2. The general-purpose gasoline engine according to claim 1, wherein a connecting line of an axis of the intake valve (5) and an axis of the exhaust valve (9) and a connecting line of an axis of the intake push rod and an axis of the exhaust push rod are intersected between the axis of the intake push rod and the axis of the exhaust push rod.

3. The general-purpose gasoline engine according to claim 1, wherein a top of the intake valve (5) is oblique towards the intake passage (12), and a top of the exhaust valve (9) is oblique towards the exhaust passage (11); and the air-cooling passage (10) is located between the intake valve (5) and the exhaust valve (9).

4. The general-purpose gasoline engine according to claim 1, wherein the combustion chamber surface (13) is of an arch structure formed by smooth transition of at least three smooth curves from a bottom to a top in turn, and the at least three smooth curves are paraboloids or hyperboloids.

5. The general-purpose gasoline engine according to claim 3, wherein the combustion chamber surface (13) is of an arch structure formed by smooth transition of at least three smooth curves from a bottom to a top in turn, and the at least three smooth curves are paraboloids or hyperboloids.

6. The general-purpose gasoline engine according to claim 1, wherein an axis of the intake valve (5) and an axis of the exhaust valve (9) are respectively vertical to a tangent plane of the combustion chamber surface (13) at respective intersection points of the combustion chamber surface (13) and a respective axis.

7. The general-purpose gasoline engine according to claim 6, wherein an internal end of a seat retainer (5*a*) of the intake valve (5) and an internal end of a seat retainer (9*a*) of the exhaust valve (9) are matched with a shape of the combustion chamber surface (13).

8. The general-purpose gasoline engine according to claim 7, wherein a connecting line, of the axis of the intake valve (5) and the axis of the exhaust valve (9), and a connecting line, of an axis of the intake push rod and an axis of the exhaust push rod, are intersected between the axis of the intake push rod and the axis of the exhaust push rod, and an included angle ($\alpha$) between the two connecting lines is 90 degrees minus or plus 20 degrees.

9. The general-purpose gasoline engine according to claim 8, wherein the general-purpose gasoline engine is of a vertical shaft structure, the connecting line of the axis of the intake valve (5) and the axis of the exhaust valve (9) is horizontal, both an intake direction of the intake passage (12) and an exhaust direction of the exhaust passage (11) are on a horizontal plane, a top of the intake valve (5) is oblique towards the intake passage (12) along the horizontal direction, and a top of the exhaust valve (9) is oblique towards the exhaust passage (11) along the horizontal direction.

10. The general-purpose gasoline engine according to claim 9, wherein the intake passage (12) is located between the intake push rod and the exhaust push rod, and a length of the intake rocker arm (8) is smaller than a length of the exhaust rocker arm (2); and wherein a resisting arm of the exhaust rocker arm (2) is oblique towards the connecting line of the axis of the intake valve (5) and the axis of the exhaust valve (9) in a vertical plane.

11. The general-purpose gasoline engine according to claim 10, wherein an included angle (3) between the axis of the intake valve (5) and the axis of the exhaust valve (9) is smaller than or equal to 30 degrees.

12. The general-purpose gasoline engine according to claim 11, wherein the intake rocker arm (8) is arranged in an intake rocker arm base (6) through an intake rocker arm shaft (7), and the exhaust rocker arm (2) is arranged in an intake exhaust rocker arm base (4) through an exhaust rocker arm shaft (3); and wherein an included angle (6) between an axis of the intake rocker arm shaft (7) and an axis of the exhaust rocker arm shaft (3) is 45 degrees minus or plus 20 degrees in the vertical plane.

13. The general-purpose gasoline engine according to claim 2, wherein a top of the intake valve (5) is oblique towards the intake passage (12), and a top of the exhaust valve (9) is oblique towards the exhaust passage (11); and wherein the through air-cooling passage (10) is located between the intake valve (5) and the exhaust valve (9).

14. The general-purpose gasoline engine according to claim 2, wherein the combustion chamber surface (13) is of an arch structure formed by smooth transition of at least three smooth curves from a bottom to a top in turn, and the at least three smooth curves are paraboloids or hyperboloids.

* * * * *